US010179398B2

(12) United States Patent
Rosenthal

(10) Patent No.: US 10,179,398 B2
(45) Date of Patent: Jan. 15, 2019

(54) JOINTING CLAMP AND METHOD FOR PRODUCING A COMPRESSION JOINT

(75) Inventor: Jörg Rosenthal, Reichsof (DE)

(73) Assignee: Viega Technology GmbH & Co. KG, Attendorn (DE)

( * ) Notice: Subject to any disclaimer, the term of this patent is extended or adjusted under 35 U.S.C. 154(b) by 743 days.

(21) Appl. No.: 13/449,021

(22) Filed: Apr. 17, 2012

(65) Prior Publication Data

US 2012/0284990 A1 Nov. 15, 2012

(30) Foreign Application Priority Data

May 9, 2011 (DE) ..... 10 2011 100 965

(51) Int. Cl.
*B25B 27/10* (2006.01)

(52) U.S. Cl.
CPC ..... *B25B 27/10* (2013.01); *Y10T 29/49826* (2015.01); *Y10T 29/53991* (2015.01)

(58) Field of Classification Search
USPC ..... 269/43, 143, 249, 3, 6; 29/276
See application file for complete search history.

(56) References Cited

U.S. PATENT DOCUMENTS 2,766,631 A 10/1956 Van Sittert
4,306,442 A 12/1981 Schröck
6,079,896 A * 6/2000 Dellach ..... 403/322.3
6,458,022 B1 * 10/2002 Folz ..... 451/365
6,553,870 B1 * 4/2003 Kendall ..... B67B 7/18 269/100
7,121,166 B2 * 10/2006 Drzewiecki ..... 81/57.33
8,286,955 B2 * 10/2012 Damang ..... 269/228
(Continued)

FOREIGN PATENT DOCUMENTS

DE 2344475 C2 9/1983
DE 29703053 U1 5/1997
(Continued)

OTHER PUBLICATIONS

European Search Report for European Application No. 12152832.7, dated Oct. 25, 213, pp. 1-6.
(Continued)

*Primary Examiner* — David Bryant
*Assistant Examiner* — Nirvana Deonauth
(74) *Attorney, Agent, or Firm* — Honigman Miller Schwartz and Cohn LLP; Fernando Alberdi; Jonathan P. O'Brien

(57) ABSTRACT

A jointing clamp for producing a compression joint, comprising: an upper jointing clamp half that can be pivoted about a first pivoting axis and has an upper main inlet contour, a lower jointing clamp half that can be pivoted about a second pivoting axis and has a lower main inlet contour, an upper contour element with an upper auxiliary inlet contour that cooperates with the upper jointing clamp half in such a way that a movement of the upper contour element is transmitted to the upper jointing clamp half and a lower contour element with a lower auxiliary inlet contour that cooperates with the lower jointing clamp half in such a way that a movement of the lower contour element is transmitted to the lower jointing clamp half. The invention furthermore relates to a corresponding method for producing a compression joint.

13 Claims, 6 Drawing Sheets

(56) References Cited

U.S. PATENT DOCUMENTS

Figure 1B:
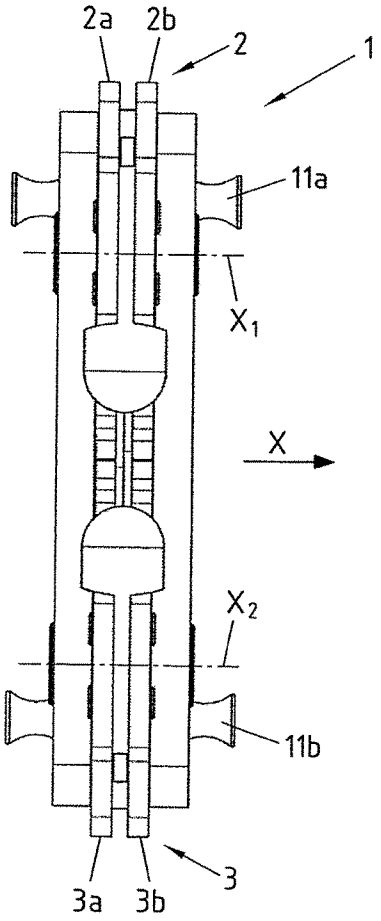

| | | | | |
|---|---|---|---|---|
| 2002/0092336 | A1* | 7/2002 | Wagner | B25B 7/12 72/409.1 |
| 2008/0216543 | A1 | 9/2008 | Hamm et al. | |
| 2010/0187740 | A1* | 7/2010 | Orgeron | 269/218 |
| 2010/0252976 | A1* | 10/2010 | Damang | 269/165 |

FOREIGN PATENT DOCUMENTS

| | | | |
|---|---|---|---|
| DE | 10029761 | C1 | 10/2001 |
| EP | 0860245 | B1 | 2/1998 |
| EP | 1170071 | A2 | 1/2002 |
| EP | 1838498 | | 10/2004 |

OTHER PUBLICATIONS

Machine Translation of EP0860245.
Machine Translation of DE-10029761-C1.

* cited by examiner

JOINTING CLAMP AND METHOD FOR PRODUCING A COMPRESSION JOINT

CROSS-REFERENCE TO RELATED APPLICATIONS

This U.S. Application is a non-provisional application that claims the benefit of German Application No. 10 2011 100 965.9, filed May 9, 2011, the entire contents of which is hereby incorporated herein by reference.

The present invention relates to a jointing clamp for producing a compression joint, comprising an upper jointing clamp half that can be pivoted about a first pivoting axis and has an upper main inlet contour, and a lower jointing clamp half that can be pivoted about a second pivoting axis and has a lower main inlet contour, wherein the upper jointing clamp half and the lower jointing clamp half can be moved relative to one another from an open position into a closed position.

The invention furthermore relates to a corresponding method for producing a compression joint by means of a jointing clamp comprising an upper jointing clamp half that can be pivoted about a first pivoting axis and has an upper main inlet contour, and a lower jointing clamp half that can be pivoted about a second pivoting axis and has a lower main inlet contour, wherein the jointing clamp halves are moved by moving a driving element of a jointing clamp drive along the upper and lower main inlet contours and thusly moving them apart from one another.

Various pressing tools for inseparably connecting a fitting and an end of a pipe inserted into the fitting by means of cold forming or for closing a compression joint in the form of a hinged and lockable coupling or the like are known from the prior art. The pressing tools respectively comprise an above-defined jointing clamp (also referred to as tension clamp) composed of two jointing clamp halves that extend from a rear end to a front end in the longitudinal direction and are connected to one another in an articulated fashion by means of side plates, wherein these jointing clamp halves respectively feature a main inlet contour on the rear end (the end facing away from the compression opening), and wherein the inlet contours cooperate with a driving element—which refers to a movable part such as, for example, a pair of rollers—of a jointing clamp drive (also referred to as pressing contour) that also forms part of the pressing tool in such a way that the movable part of the jointing clamp drive moves along and presses apart the main inlet contours when it is displaced in the longitudinal direction toward the front end of the jointing clamp halves in order to transfer the jointing clamp halves from the open position into the closed position.

The so-called upper and lower main inlet contour respectively is a curved surface of the respective jointing clamp half that faces the driving element such as, for example, the pair of rollers and along which the driving element is moved. The farther said driving element is moved in the direction of the compression opening, the farther the jointing clamp halves are spread apart on their rear end and the farther the compression opening closes on the front end.

The open position refers to the position of the jointing clamp halves, in which the compression opening has its maximum width. Accordingly, the closed position refers to the position of the jointing clamp halves, in which the compression opening has its minimum width, i.e., in which the opening angle usually is 0°.

The pressing tools of the above-described type are also object of the present invention and, as mentioned above, comprise a jointing clamp and a jointing clamp drive, wherein these pressing tools serve for enclosing a certain area of a fitting or for taking hold of two radially protruding tabs of a coupling or the like after the pipe was respectively inserted into the fitting or the coupling. Subsequently, the jointing clamps are moved in the direction of the closed position due to a movement of the driving element of the jointing clamp drive such that the compression opening is compressed. In case of a fitting, a cold-formed joint between the enclosed areas is thusly produced. When a coupling is used, it is closed in the area of the tabs, for example, with the aid of a snap-lock connection in this area.

The usually hydraulic pressing tools used for the installation technology are pressure-controlled. In this case, the length of the stroke being carried out is limited such that only a certain work capacity is available per pressing operation. Consequently, more than one jointing clamp stroke is required if the required deformation work on the compression joint such as, for example, the fitting or the coupling exceeds the work capacity of the pressing tool. Until now, a pressing operation therefore could not be carried out with only a single jointing clamp in such instances. It was rather required to either use a pressing tool, the stroke of which could be selectively increased, or two different jointing clamps with different sizes, as well as a pressing tool with a work capacity that could be selectively increased. A significant effort is involved in both instances.

The present invention therefore is based on the objective of developing a jointing clamp, a corresponding pressing tool and a method for producing a compression joint that also make it possible to realize long strokes with simple means.

According to a first aspect of the present invention, the above-defined objective is attained with a jointing clamp for producing a compression joint comprising an upper jointing clamp half that can be pivoted about a first pivoting axis and has an upper main inlet contour, and a lower jointing clamp half that can be pivoted about a second pivoting axis and has a lower main inlet contour, an upper contour element with an upper auxiliary inlet contour that cooperates with the upper jointing clamp half in such a way that a movement of the upper contour element is transmitted to the upper jointing clamp half, and a lower contour element with a lower auxiliary inlet contour that cooperates with the lower jointing clamp half in such a way that a movement of the lower contour element is transmitted to the lower jointing clamp half, wherein the upper jointing clamp half and the lower jointing clamp half can be moved relative to one another from an open position into a closed position, and wherein the upper auxiliary inlet contour can be displaced relative to the upper main inlet contour and the lower auxiliary inlet contour can be displaced relative to the lower main inlet contour.

According to the invention, a main inlet contour, as well as an auxiliary inlet contour, is provided on each jointing clamp half of one and the same jointing clamp. The auxiliary inlet contour can be activated or deactivated on demand by displacing it relative to the main inlet contour. Not only the auxiliary inlet contour, but also the main inlet contour may be movable relative to the jointing clamp half, to which it is connected (to which it is assigned).

If a large opening width is required in order to realize a pressing operation, the driving element, i.e., the movable part of the jointing clamp drive, initially can be moved along the main inlet contour while the auxiliary inlet contour is deactivated, i.e., while it does not protrude into the effective range of the driving element. The upper and the lower jointing clamp halves are pressed apart by moving the driving element such as, for example, a pair of rollers along the main inlet contours such that the compression opening, i.e., the front part of the two jointing clamp halves, accordingly moves in the direction of the closed position and reduces the opening width. An intermediate position of the jointing clamp halves that lies between the maximum opening width and the minimum opening width is reached after the driving element has been moved along the entire main inlet contour. In this intermediate position, the auxiliary inlet contour can be engaged or activated, wherein the auxiliary inlet contour is moved into the effective range of the driving element and positions itself, in particular, above the main inlet contour such that the latter is deactivated, namely on the upper and the lower jointing clamp half. It would also be conceivable that the respective main inlet contour is moved from the previous position relative to the assigned jointing clamp half, i.e., out of the effective range of the driving element, and therefore deactivated before or while the respective auxiliary inlet contour is engaged (activated).

In other words, the shape of the effective surface of the inlet contour is changed in the intermediate position in accordance with the invention. Before this change is carried out or the auxiliary inlet contour is engaged, respectively, it is proposed, in particular, to move the driving element out of the effective range of the main inlet contour and back in the direction of its initial position for this change-over process. If applicable, the respective main inlet contour then may also be deactivated as mentioned above. As soon as the auxiliary inlet contour has been engaged, the driving element is once again moved in the direction of the front end of the jointing clamp such that it moves along the auxiliary inlet contour and the two jointing clamp halves are moved even farther apart from one another, wherein this ultimately leads to the compression opening closing even farther until the closed position is reached.

In instances, in which only a small opening width of the jointing clamp is required for producing a compression joint, the auxiliary inlet contour may be arranged in the active position in the first place. In this case, the jointing clamp is only displaced from the intermediate position into the closed position in order to produce the compression joint.

This means that according to the invention, a first stroke is realized in that the driving element is moved along the main inlet contour. A second stroke that follows the first stroke is realized in that the driving element is moved along the engaged auxiliary inlet contour. According to the invention, two strokes therefore are realized with one and the same jointing clamp. An exchange of the jointing clamp during the pressing operation therefore is no longer required. Consequently, the operation of the jointing clamp is accelerated and becomes more convenient for the operator. In addition, it is possible to continue using the customary and conventional pressing tool systems such that no conversions are required for the operator and the customer.

According to an embodiment of the inventive jointing clamp, the upper and the lower auxiliary inlet contours can, as mentioned above, be displaced between an inactive and an active position, wherein the respective auxiliary inlet contour partially or completely covers the respective main inlet contour in the active position, particularly in the direction, from which the driving element arrives. Consequently, at least one auxiliary inlet contour is always assigned to a main inlet contour. According to the invention, the displacement between the inactive and the active position particularly takes place simultaneously, but may basically also take place successively.

According to another embodiment of the inventive jointing clamp, it furthermore comprises a first synchronization plate, to which the upper contour element is connected in such a way that a movement of the first synchronization plate is transmitted to the upper contour element, and a second synchronization plate, to which the lower contour element is connected in such a way that a movement of the second synchronization plate is transmitted to the lower contour element. Due to the two synchronization plates that are arranged, in particular, rotatably and/or displaceably relative to the jointing clamp halves, the upper auxiliary inlet contour can be displaced relative to the upper main inlet contour and the lower auxiliary inlet contour can be displaced relative to the lower main inlet contour, i.e., the respective auxiliary inlet contour can be moved or changed over between the active and the inactive position. However, it would basically also be conceivable to provide a common synchronization plate for both contour elements instead of two synchronization plates that are respectively connected to one contour element, wherein this common synchronization plate can be moved relative to the upper jointing clamp half and the lower jointing clamp half and therefore can move the two contour elements back and forth between the active and the inactive position. In this way, the upper and the lower auxiliary inlet contour are respectively moved into or out of the effective range of a driving element of the jointing clamp drive, particularly a pair of rollers. The jointing clamp drive may feature a plunger that can be actuated mechanically, hydraulically or pneumatically.

According to yet another embodiment of the inventive jointing clamp, at least one guide contour or synchronization contour, particularly in the form of at least one guide slot or at least one guide groove, is respectively formed in the first and the second synchronization plate and cooperates with a counterpart that can be moved relative thereto, particularly a guide projection or guide pin. The counterpart, particularly the guide projection or guide pin, is anchored on or connected to the jointing clamp half that is spaced apart from the respective guide or synchronization contour in the transverse direction. In the context of the present invention, the term transverse direction respectively refers to the direction extending transverse to the direction, in which the inlet contours extend, or transverse to the plane, in which the jointing clamp halves move between the open position and the closed position.

According to the preceding embodiment, the counterpart such as, for example, a guide pin travels on or in the synchronization contour when the respective synchronization plate is moved relative to the jointing clamp half. In this case, the shape of the synchronization contour is chosen such that the respective auxiliary inlet contour is displaced between the inactive position and the active position relative to the jointing clamp halves on a predefined path.

According to an additional embodiment, at least one guide contour, particularly at least one guide slot or at least one guide groove, is also respectively formed in the upper and the lower jointing clamp half, wherein the guide contour cooperates with a counterpart that can be moved relative thereto, particularly a guide projection or guide pin. The upper and the lower jointing clamp halves may feature, in particular, at least two such guide contours that cooperate with corresponding counterparts. In this case, the counterpart such as, for example, the guide pin is also anchored, in particular, on the synchronization plate that lies adjacent to the respective guide contour in the transverse direction. In this case, the shape of the guide contour is chosen such that a movement of the counterpart such as, for example, a guide pin causes the respective synchronization plate to move relative to the jointing clamp halves on a predefined path that is also defined by the shape of the guide contour in the synchronization plate. In this context, it would be conceivable that the counterpart, i.e., the guide pin, protrudes out of the jointing clamp in the transverse direction and/or in or opposite to the longitudinal direction (direction from the inlet contours toward the compression opening) and/or is provided with a handle for being actuated manually. In this way, the operator may, if so required, manually move the synchronization plates and thusly realize a change-over between the aforementioned active position and the aforementioned inactive position such that the auxiliary inlet contour is displaced relative to the main inlet contour. In this context, it would also be conceivable that the counterpart, i.e., the guide pin that protrudes out of the jointing clamp and/or is provided with a handle, needs to be moved against the force of a spring when said counterpart or said guide pin is moved out of its two end positions, i.e., the position that corresponds to the active state of the auxiliary inlet contour and the position that corresponds to the inactive state of the auxiliary inlet contour. A spring prestress may serve as a safety against an unintentional change-over or for simplifying the change-over in one or both directions.

According to another embodiment of the inventive jointing clamp, the upper jointing clamp half and the lower jointing clamp half are arranged relative to one another in such a way in the open position that the upper and the lower main inlet contours lie inside and the upper and the lower auxiliary inlet contours lie outside the effective range of a driving element of the jointing clamp drive. Accordingly, the upper jointing clamp half and the lower jointing clamp half may be arranged relative to one another in such a way in the closed position that the upper and the lower main inlet contours lie outside and the upper and the lower auxiliary inlet contours lie inside the effective range of a driving element of the jointing clamp drive. In this way, the two inlet contours, i.e., the main inlet contour on the one hand and the auxiliary inlet contour in the other hand, do not influence or interfere with one another when one of the inlet contours is activated, i.e., when it lies in the effective range of the driving element. As mentioned above, it would also be conceivable to move the respective main inlet contour out of its previous position before or while the respective auxiliary inlet contour is activated in order to not interfere with the engagement or activation of the respective auxiliary inlet contour. In this case, the main inlet contour can be moved relative to the jointing clamp half between an activated and a deactivated position, particularly also independently of the position of the assigned jointing clamp half.

According to yet another embodiment of the inventive jointing clamp, the jointing clamp halves and/or synchronization plates are realized in such a way that the upper jointing clamp half and the lower jointing clamp half need to be arranged in an intermediate position in order to respectively move the first and the second synchronization plates relative to the upper jointing clamp half, as well as relative to the lower jointing clamp half. In this case, it is preferred that the first and the second synchronization plates are blocked in any position other than the intermediate position, i.e., particularly also in the open position and in the closed position. Consequently, a change-over between the active position of the auxiliary inlet contour and the inactive position of the auxiliary inlet contour is only possible in the intermediate position in this case.

According to another embodiment of the inventive jointing clamp, the upper jointing clamp half and the lower jointing clamp half can be respectively blocked or locked in an intermediate position, particularly in the intermediate position, in which the above-described change-over between the active position and the inactive position of the auxiliary inlet contour takes place. In this way, the jointing clamp halves are secured against unintentionally moving apart from one another. This measure also prevents the jointing clamp from unintentionally separating from the component to be compressed during the change-over between said active and inactive positions of the auxiliary inlet contour. Accordingly, it is also prevented that the operator of the jointing clamp needs to hold the component to be compressed in the partially compressed state during the change-over between the active and the inactive position. The jointing clamp halves are respectively blocked or locked in the intermediate position, in particular, with the aid of a locking pin or securing pin that fixes the two jointing clamp halves relative to one another. Said blocking is preferably realized automatically due to the movement of the jointing clamp halves such that the locking pin automatically reaches a locking position relative to the jointing clamp halves in the intermediate position.

According to yet another embodiment of the inventive jointing clamp, the upper jointing clamp half and/or the lower jointing clamp half respectively consists of several plates, particularly of a pair of plates, wherein the several plates, particularly the pair of plates, comprises at least two plates of, in particular, the same shape that are arranged adjacent to one another in the transverse direction and spaced apart from one another. In this way, a cavity or a gap is respectively formed in the interior of the corresponding jointing clamp half, namely between the at least two individual plates, and can be used for accommodating the components that serve for changing over between the active position and the inactive position of the auxiliary inlet contour. Particularly the synchronization plates and/or contour elements can be at least sectionally arranged in this gap. In this context, it would be conceivable that the contour elements have a T-shaped cross section, wherein the center bar of the "T"-profile is guided in said intermediate space between the at least two individual plates and the remaining part that forms the auxiliary inlet contour is moved outside the intermediate space. In this case, the section of the contour element that is arranged outside the intermediate space may have a minimum width in the transverse direction that corresponds to the distance between the outer sides of the at least two individual plates forming the respective jointing clamp half. In other words, the part of the contour element that forms the auxiliary inlet contour is at least exactly as wide as the respective jointing clamp half and therefore at least exactly as wide as the respective main inlet contour.

In instances, in which the jointing clamp halves are respectively formed by several plates, the first and/or the second synchronization plate may be transversely arranged between the at least two plates of the upper jointing clamp half and/or between the at least two plates of the lower jointing clamp half. In this way, the synchronization plates are also optimally protected from damages.

According to another embodiment of the inventive jointing clamp, the first and the second synchronization plates are arranged adjacent to one another in the transverse direction and rotationally symmetrical (axially symmetrical) to one another. Consequently, the synchronization plates have the same shape and are turned relative to one another about an axis that extends in the transverse direction. In this way, a particularly simple design and also a particularly simple manufacture of the jointing clamp are ensured.

The first and the second synchronization plates are, according to yet another embodiment of the inventive jointing clamp, made of sheet metal, particularly punched from sheet metal. Since relatively high forces act upon the upper and the lower jointing clamp halves and/or the upper and the lower contour elements in the region of the respective inlet contour, they may consist of a metal casting or also of sheet metal, particularly a metal punching.

According to a second aspect of the present invention, the aforementioned objective is furthermore attained with a pressing tool that features a jointing clamp of the above-defined type. The pressing tool may additionally comprise a jointing clamp drive of the above-described type, wherein the driving element of the jointing clamp drive consists, in particular, of a pair of rollers. The jointing clamp drive may feature a plunger that can be actuated hydraulically or pneumatically, particularly moved in a translatory fashion, and displaced between the two jointing clamp halves in such a way that the driving element such as, for example, the pair of rollers can be moved along the main inlet contour and (in the activated state) the auxiliary inlet contour of the respective jointing clamp half.

According to a third aspect of the present invention, the aforementioned objective is also attained with a method for producing a compression joint by means of a jointing clamp comprising an upper jointing clamp half that can be pivoted about a first pivoting axis and has an upper main inlet contour, and a lower jointing clamp half that can be pivoted about a second pivoting axis and has a lower main inlet contour, an upper contour element with an upper auxiliary inlet contour that cooperates with the upper jointing clamp half in such a way that a movement of the upper contour element is transmitted to the upper jointing clamp half, and a lower contour element with a lower auxiliary inlet contour that cooperates with the lower jointing clamp half in such a way that a movement of the lower contour element is transmitted to the lower jointing clamp half, particularly a jointing clamp of the above-defined type, wherein the jointing clamp halves are initially moved from the open position into an intermediate position (first stroke) by moving a driving element of a jointing clamp drive along the upper and the lower main inlet contours such that they are moved apart from one another, wherein the upper auxiliary inlet contour is displaced relative to the upper main inlet contour and the lower auxiliary inlet contour is displaced relative to the lower main inlet contour in the intermediate position, and wherein the jointing clamp halves are subsequently moved from the intermediate position into the closed position (second stroke) by moving the driving element along the upper and the lower auxiliary inlet contours such that they are moved apart from one another and the upper and the lower main inlet contours are in turn moved even farther apart from one another.

According to one embodiment of the method according to the invention, the driving element is in the intermediate position moved back in the direction, in which the driving element is situated relative to the jointing clamp halves in the open position, namely before the upper auxiliary inlet contour is displaced relative to the upper main inlet contour and the lower auxiliary inlet contour is displaced relative to the lower main inlet contour.

According to yet another embodiment of the method according to the invention, a first synchronization plate, to which the upper contour element is connected in such a way that a movement of the first synchronization plate is transmitted to the upper contour element, and a second synchronization plate, to which the lower contour element is connected in such a way that a movement of the second synchronization plate is transmitted to the lower contour element, are in the intermediate position respectively moved relative to the upper jointing clamp half and the lower jointing clamp half in order to displace the upper auxiliary inlet contour relative to the upper main inlet contour and the lower auxiliary inlet contour relative to the lower main inlet contour.

As mentioned above, it is preferred to move the first and the second synchronization plates simultaneously and, in particular, manually in this case.

As a precaution, it should be noted that the preceding description indeed always refers to an upper and a lower contour element, as well as to an upper and a lower auxiliary inlet contour. However, this does not preclude that several upper and/or lower contour elements may be provided per jointing clamp half and several upper and lower auxiliary inlet contours may be provided per contour element. This basically also applies to the main inlet contours, but exactly one main inlet contour preferably is assigned or connected to the respective jointing clamp half moved by the main inlet contour.

Figure 1A:
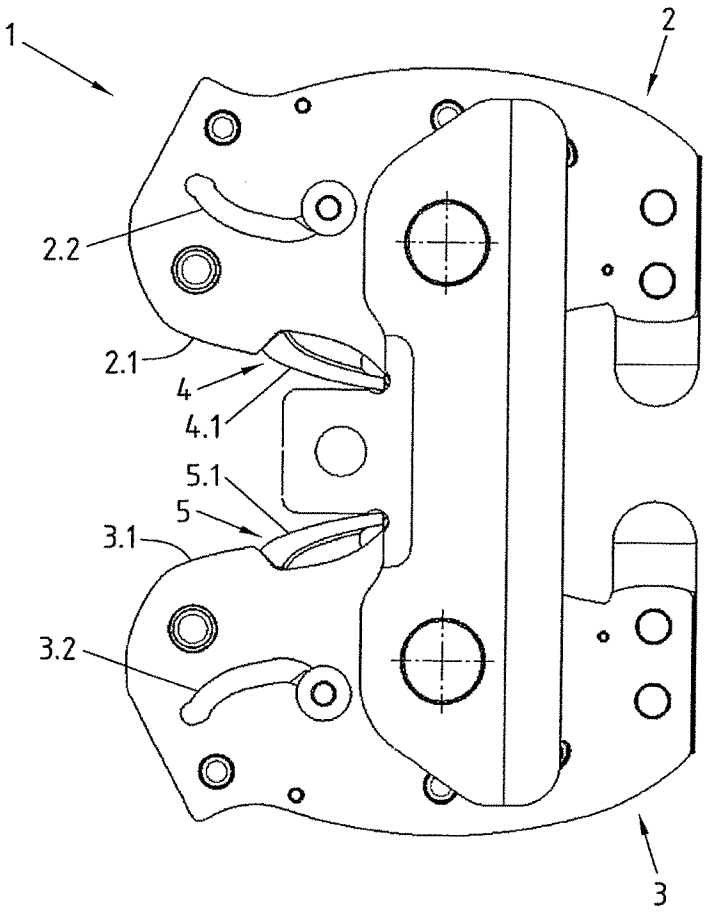
Figure 2:
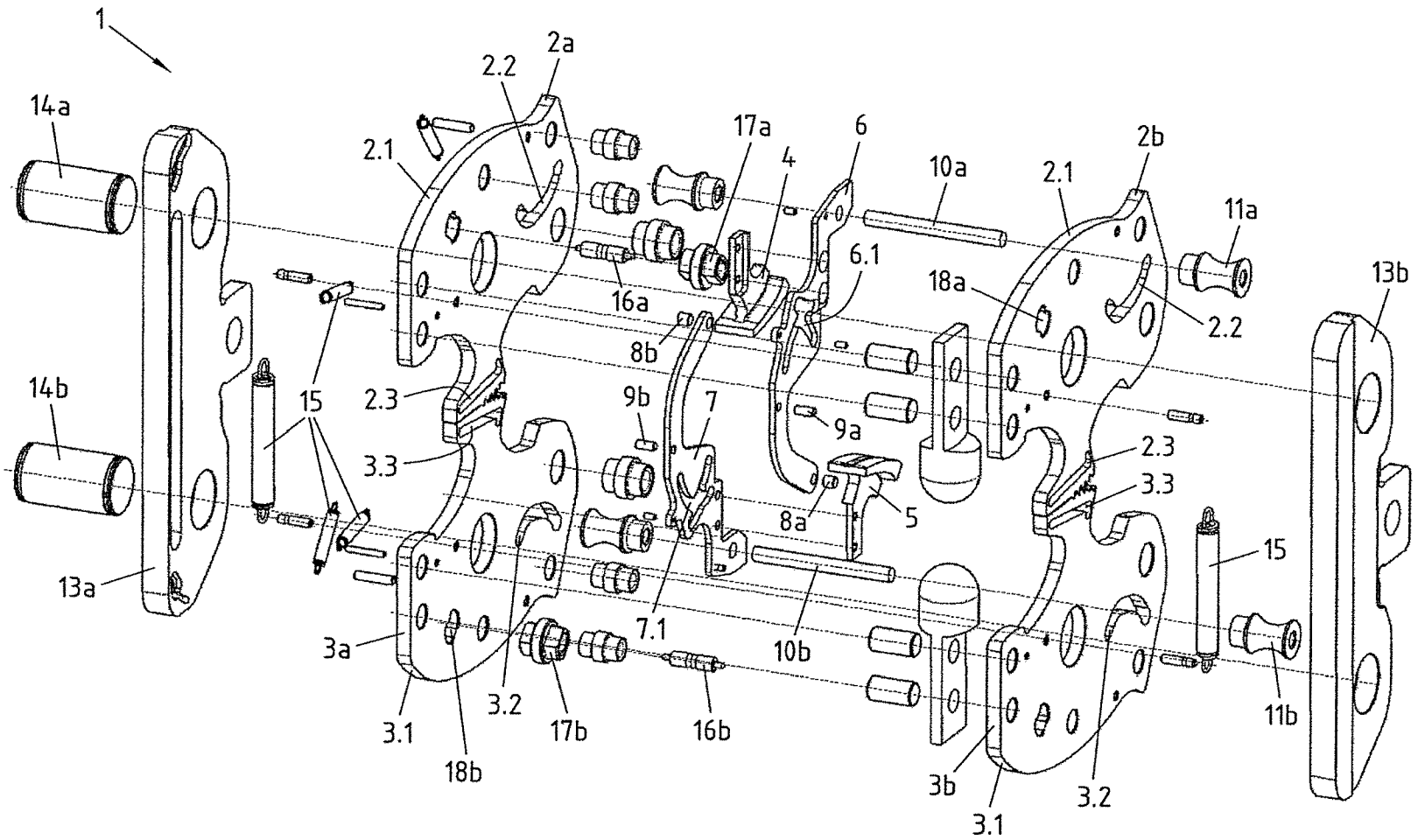
Figure 3C:
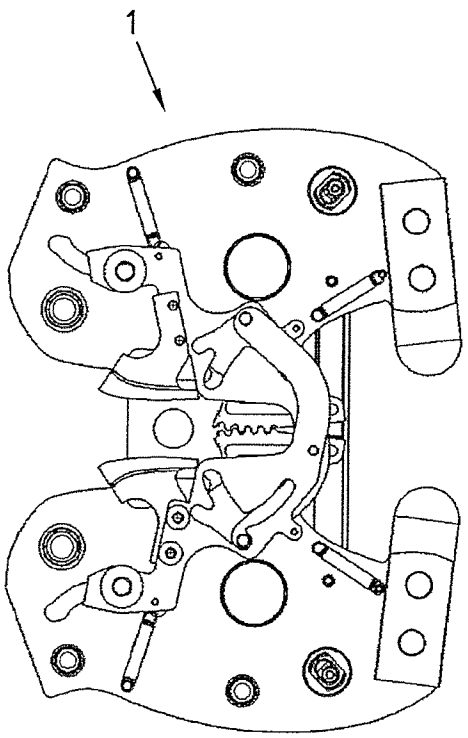
Figure 3B:
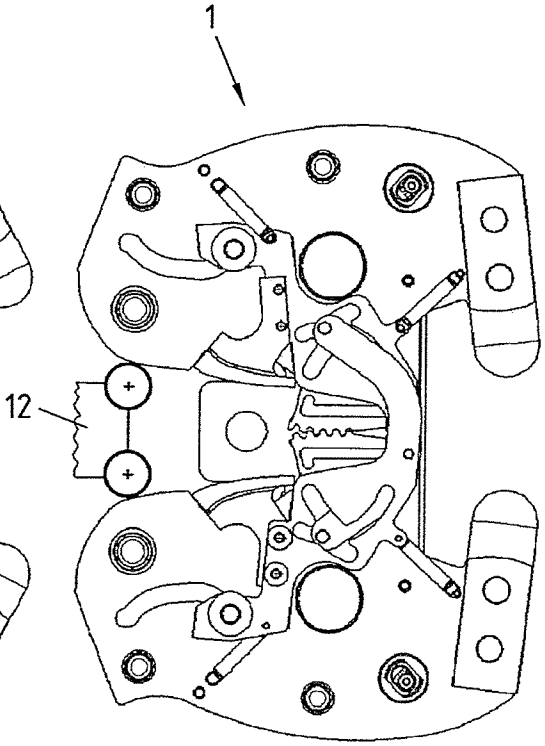
Figure 3A:
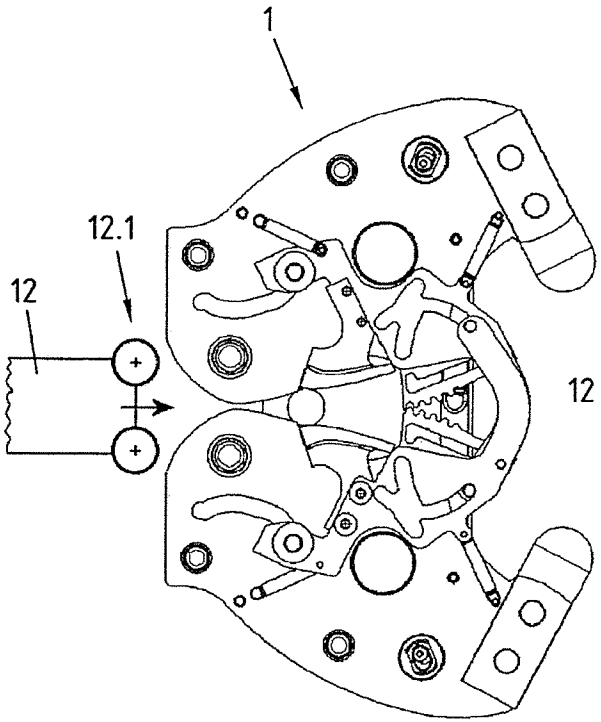
Figure 4:
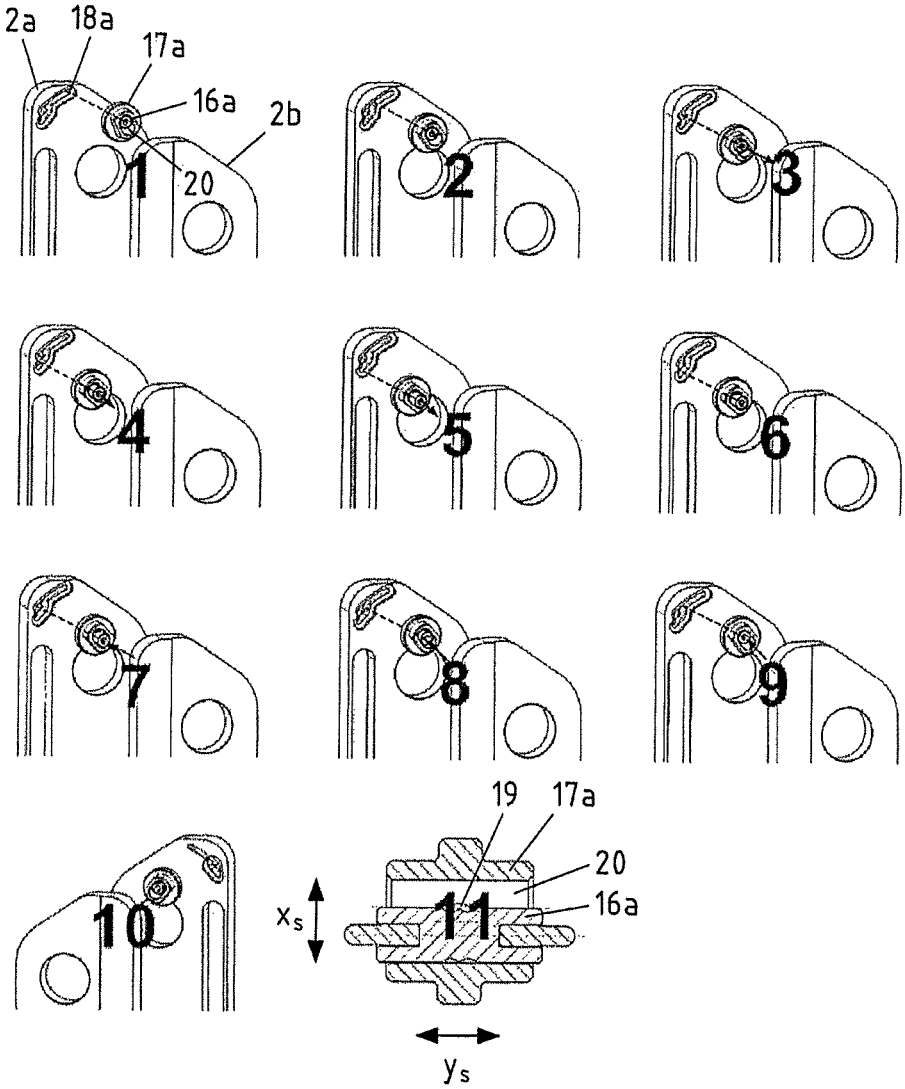

A number of options are available for modifying and additionally developing the inventive jointing clamp, the inventive pressing tool and the method according to the invention. In this respect, we refer to the claims that are subordinate to claim 1 on the one hand and to the description of exemplary embodiments in connection with the drawings on the other hand. In these drawings:

FIG. 1*a*) shows a side view of an inventive jointing clamp,

FIG. 1*b*) shows a front view of the jointing clamp according to FIG. 1*a*), FIG. 2 shows an exploded view of the jointing clamp according to FIG. 1*a*), FIGS. 3*a*) to *g*) show different working positions of the jointing clamp according to FIG. 1*a*) as part of a pressing tool during the production of a compression joint, and FIG. 4 shows the function of a locking mechanism for the jointing clamp according to FIG. 1*a*).

FIGS. 1*a*) and *b*) respectively show a side view (FIG. 1*a*)) and a front view (FIG. 1*b*)) of a jointing clamp 1 for producing a compression joint. The jointing clamp 1 features an upper jointing clamp half 2 that can be pivoted about a first pivoting axis X1 and has an upper main inlet contour 2.1 and a lower jointing clamp half 3 that can be pivoted about a second pivoting axis X2 and has a lower main inlet contour 3.1. According to FIGS. 3*a*) and *b*), the main inlet contour 2.1 and the main inlet contour 3.1 cooperate with a driving element 12.1 in the form of a pair of rollers that forms part of a jointing clamp drive 12. In this case, the jointing clamp drive 12 or the driving element 12.1 respectively can be hydraulically moved in the direction from the rear jointing clamp end toward the front jointing clamp end (indicated with an arrow) and thusly presses the jointing clamp halves 2 and 3 apart from one another at the rear end of the jointing clamp such that the jointing clamp halves respectively move toward one another or close at the front end, i.e., at the compression opening.

The jointing clamp 1 furthermore features an upper contour element 4 with an upper auxiliary inlet contour 4.1 and a lower contour element 5 with a lower auxiliary inlet contour 5.1. The upper contour element 4 cooperates with the upper jointing clamp half 2 in such a way that a movement of the upper contour element 4 is transmitted to the upper jointing clamp half 2. This also applies accordingly to the lower contour element 5 that cooperates with the lower jointing clamp half 3 in such a way that a movement is transmitted to the lower jointing clamp half 3.

According to FIGS. 3*a*) to *g*), the upper jointing clamp half 2 and the lower jointing clamp half 3 can be moved from an open position (FIG. 3*a*)) into a closed position (FIG. 3*g*)) via an intermediate position (FIGS. 3*b*) to *e*)). In this case, the upper auxiliary inlet contour 4.1 can be displaced relative to the upper main inlet contour 2.1 and the lower auxiliary inlet contour 5.1 can be displaced relative to the lower main inlet contour 3.1 as described in greater detail below.

Figure 3E:
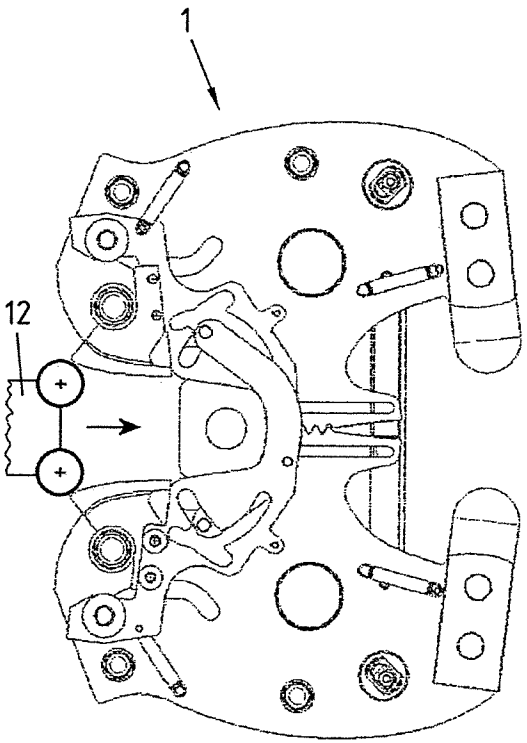
Figure 3D:
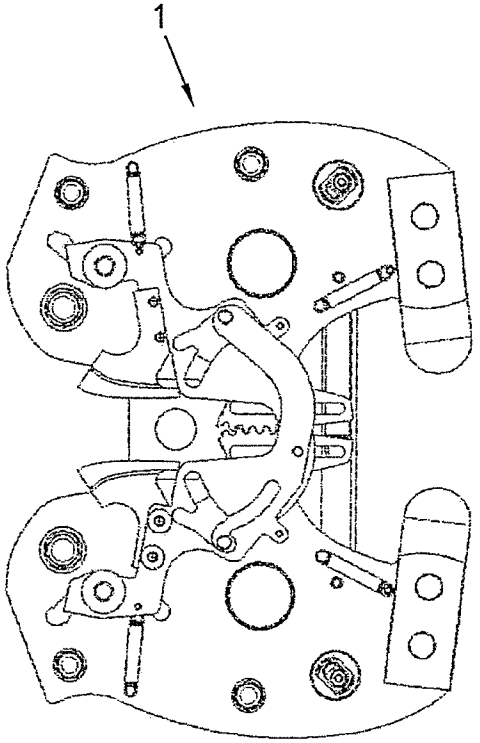
Figure 3G:
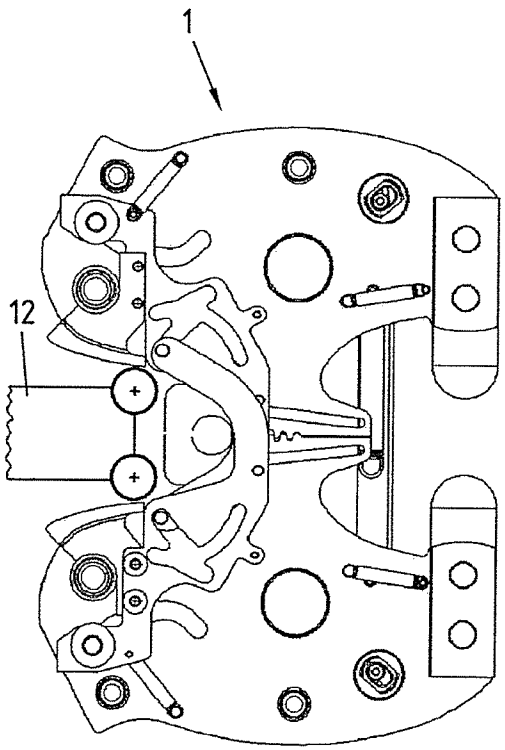
Figure 3F:
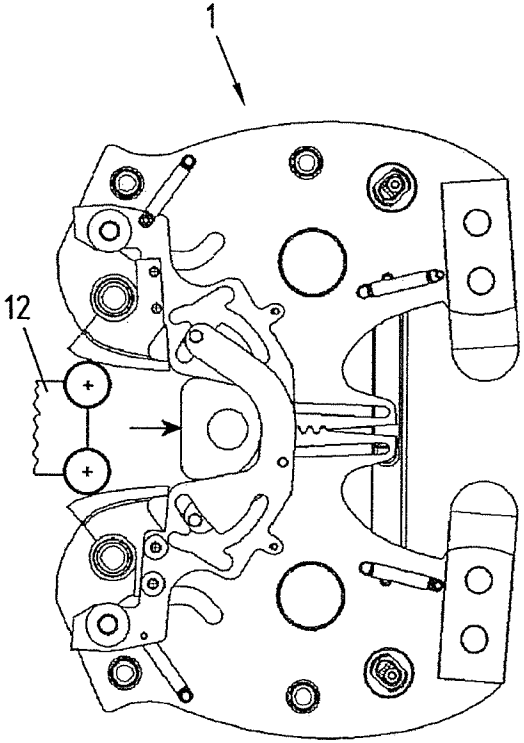

FIGS. 3*a*) and *b*) show how a first stroke from the open position into the intermediate position is carried out in that the jointing clamp drive 12 moves the driving element 12.1 with its rollers along the main inlet contours 2.1 and 3.1. FIGS. 3*c*) to *e*) show how the auxiliary inlet contours 4.1 and 5.1 are in the intermediate position displaced from an inactive position into an active position, in which they partially cover the respective main inlet contour 2.1 or 3.1 toward the rear jointing clamp end and protrude into the effective range of the driving element 12.1. In order to realize the change-over from the inactive position into the active position, the jointing clamp drive 12 is initially returned into the initial position that it originally assumed in FIG. 3*a*). After the auxiliary inlet contours 4.1 and 5.1 have been activated, the jointing clamp drive 12 is once again actuated such that the jointing clamp halves 2 and 3 carry out a second stroke from the intermediate position into the closed position as illustrated in FIGS. 3*e*) to *g*). In the closed position (FIG. 3*g*)), the opening angle of the compression opening is 0°.

The components that respectively allow the activation and deactivation of the auxiliary inlet contours 4.1 and 5.1 or their displacement between the inactive and the active positions are illustrated in detail in the exploded view according to FIG. 2. The jointing clamp 1 features a first synchronization plate 6 and a second synchronization plate 7. The first synchronization plate 6 is rigidly screwed to the upper contour element 4, namely in such a way that a movement of the first synchronization plate 6 is transmitted to the upper contour element 4. The second synchronization plate 7 is accordingly connected to the lower contour element 5. The first synchronization plate 6 and the second synchronization plate 7 can be respectively moved relative to the upper and the lower jointing clamp halves 2 and 3.

Synchronization contours in the form of respective guide slots 6.1 and 7.1 are formed in the first and the second synchronization plates 6 and 7 and cooperate with counterparts in the form of respective guide pins 8*a* and 8*b*. In this case, the respective guide pins 8*a* and 8*b* are anchored on the respective jointing clamp half 2 or 3 that lies adjacent to the respective guide slot 6.1 or 7.1 in the transverse direction X.

Furthermore, respective first guide slots 2.2 and 3.2 and respective second guide slots 2.3 and 3.3 are formed in the two jointing clamp halves 2 and 3. The guide slot 2.2 cooperates with a guide pin 10*a* and the guide slot 3.2 cooperates with a guide pin 10*b*. The additional guide slot 2.3 cooperates with another guide pin 9*a* and the additional guide slot 3.3 cooperates with a guide pin 9*b*. All guide pins are respectively anchored on the synchronization plate 6 or 7 that lies adjacent to the corresponding guide slot 2.2, 2.3, 3.2, 3.3 in the transverse direction X. The two guide pins 10*a* and 10*b* are furthermore provided with handles 11*a* and 11*b*, by means of which the pins 10*a* and 10*b* can be displaced in the respective guide slots 2.2 and 3.2.

All guide slots 2.2, 2.3, 3.2, 3.3, 6.1, 7.1 in the jointing clamp halves 2 and 3 and in the synchronization plates 6 and 7 respectively extend in such a way that an actuation or displacement of the guide pins 10*a* and 10*b* causes the synchronization plates 6 and 7 to be turned and displaced together with the contour elements 4 and 5, namely such that the corresponding auxiliary inlet contours 4.1 and 5.1 can be changed over between an inactive position and an active position in the above-described fashion.

In the open position, the upper jointing clamp half 2 and the lower jointing clamp half 3 are arranged relative to one another, in particular, in such a way that the upper and the lower main inlet contours 2.1 and 3.1 lie in the effective range and the upper and the lower auxiliary inlet contours 4.1 and 5.1 lie outside the effective range of the driving element 12.1 of the jointing clamp drive 12. In the closed position, the upper and the lower jointing clamp halves 2 and 3 are arranged such that the upper and the lower main inlet contours 2.1 and 3.1 lie outside the effective range and the upper and the lower auxiliary inlet contours 4.1 and 5.1 lie in the effective range of the driving element 12.1.

Furthermore, the two jointing clamp halves 2 and 3 and the synchronization plates 6 and 7 are arranged and shaped in such a way that the jointing clamp halves 2 and 3 need to be arranged in the above-described intermediate position in order to respectively move the synchronization plates 6 and 7 relative to the jointing clamp halves 2 and 3. The synchronization plates 6 and 7 are realized and arranged in a rotationally symmetrical fashion in this case and blocked in any position other than the intermediate position.

FIG. 2 shows very clearly that the jointing clamp halves 2 and 3 respectively consist of a pair of plates, namely of respective plates 2*a*, 2*b* and 3*a*, 3*b* of the same shape that are arranged adjacent to one another in the transverse direction X and spaced apart from one another. The thusly realized jointing clamp halves 2 and 3 are held together by side plates 13*a* and 13*b* that in turn serve for accommodating two main pins 14*a* and 14*b*, on which the jointing clamp halves 2 and 3 are ultimately supported in a pivoting fashion.

FIG. 2 furthermore shows that various tension springs 15 are provided, wherein some tension springs promote the movements of the components causing the displacement of the auxiliary inlet contours 4.1 and 5.1 between the active position and the inactive position and some tension springs assist in preserving different positions of the components relative to one another due to their prestress.

FIG. 2 ultimately also shows that so-called locking pins 16*a* and 16*b* are respectively provided on each jointing clamp half 2 and 3 and make it possible to block the jointing clamp halves 2 and 3 in the intermediate position. The thusly realized locking mechanism is described below with reference to FIG. 4.

In order to realize the aforementioned two strokes in the jointing clamp 1, it is advantageous that a locking mechanism blocks or locks the opening of the jointing clamp 1 between the first stroke and the second stroke such that the operator does not have to remove the jointing clamp 1 and interrupt the pressing operation. The locking mechanism has four switching positions that are illustrated in Picture 11 of FIG. 4 and can be stabilized with a spring-loaded spherical thrust member. The locking pin 16*a* can be switched in the axial direction $y_s$ and in the direction of the oblong hole 20 in the hollow bolt 17*a*. At the beginning, the locking pin 16*a* is engaged in the side plate 2*a* that is illustrated in Picture 1 of FIG. 4 and then switched into the opposite side plate 2*b* (FIG. 4, Pictures 2 and 3) in the axial direction $y_s$ by the guide groove 18*a* in the side plate 2*a* as the closing movement progresses. An undercut in the side plate 2*b* subsequently prevents a reversal of the rotational movement of the jointing clamp 1 (FIG. 4, Picture 10). As the closing movement progresses, the locking pin 16*a* is switched inward in the direction of the oblong hole 20 (FIG. 4, Pictures 4 and 5). After the completion of the pressing operation, the locking pin 16*a* returns to the second guide groove and is initially switched axially (FIG. 4, Pictures 6 and 7) and then outward in the direction of the oblong hole 20 (FIG. 4, Pictures 8 and 9). In this way, the locking pin 16*a* is once again returned into the initial position illustrated in Picture 2 of FIG. 4 such that the jointing clamp 1 can be completely opened again.

The invention claimed is:

1. A jointing clamp for producing a compression joint, comprising:

an upper jointing clamp half that is configured to be pivoted about a first pivoting axis and has an upper main inlet contour, a lower jointing clamp half that is configured to be pivoted about a second pivoting axis and has a lower main inlet contour, an upper contour element with an upper auxiliary inlet contour that is connected to and cooperates with the upper jointing clamp half in such a way that a movement of the upper contour element is transmitted to the upper jointing clamp half, and a lower contour element with a lower auxiliary inlet contour that is connected to and cooperates with the lower jointing clamp half in such a way that a movement of the lower contour element is transmitted to the lower jointing clamp half, wherein the upper jointing clamp half and the lower jointing clamp half is configured to be moved relative to one another from an open position into a closed position, wherein the upper auxiliary inlet contour is configured to be displaced relative to the upper main inlet contour, and wherein the lower auxiliary inlet contour is configured to be displaced relative to the lower main inlet contour, wherein the upper auxiliary inlet contour is configured to be displaced relative to the upper main inlet contour and is configured to thereby be activated, wherein the lower auxiliary inlet contour is configured to be displaced relative to the lower main inlet contour and is configured to thereby be activated, wherein each of the upper auxiliary inlet contour and the lower auxiliary inlet contour remains activated after displacement, wherein a driving element of a jointing clamp drive is configured to press the jointing clamp halves apart from one another, such that when the driving element comes in direct contact with and is moved along each of the upper main inlet contour and the lower main inlet contour, a first stroke of the jointing halves is performed and such that when, after moving the driving element out of an effective range of each of the upper main inlet contour and the lower main inlet contour and after displacement of each of the upper auxiliary inlet contour and the lower auxiliary inlet contour to be activated, the driving element comes in direct contact with and is moved along each of the upper auxiliary inlet contour and the lower auxiliary inlet contour, a second stroke of the jointing clamp halves is performed, wherein the upper and the lower auxiliary inlet contours are configured to be moved apart from one another during the second stroke, thereby moving the jointing clamp halves farther apart from each other and producing the compression joint.

2. The jointing clamp according to claim 1, wherein it further comprises:

a first synchronization plate, to which the upper contour element is connected in such a way that a movement of the first synchronization plate is transmitted to the upper contour element, and a second synchronization plate, to which the lower contour element is connected in such a way that a movement of the second synchronization plate is transmitted to the lower contour element, wherein the jointing clamp is configured such that the first synchronization plate and the second synchronization plate can be respectively moved relative to the upper jointing clamp half, as well as relative to the lower jointing clamp half.

3. The jointing clamp according to claim 2, wherein at least one guide contour is respectively formed in the first and the second synchronization plates and cooperates with a counterpart configured be moved relative thereto.

4. The jointing clamp according to claim 1, wherein at least one guide contour is respectively formed in the upper and the lower jointing clamp halves and cooperates with a counterpart configured to be moved relative thereto.

5. The jointing clamp according to claim 1, wherein in the open position the upper jointing clamp half and the lower jointing clamp half are arranged relative to one another such that the upper and the lower main inlet contours lie inside and the upper and the lower auxiliary inlet contours lie outside an effective range of the driving element of the jointing clamp drive.

6. The jointing clamp according to claim 1, wherein in the closed position the upper jointing clamp half and the lower jointing clamp half are arranged relative to one another such that the upper and the lower main inlet contours lie outside and the upper and the lower auxiliary inlet contours lie inside an effective range of the driving element of the jointing clamp drive.

7. The jointing clamp according to claim 2, wherein the jointing clamp halves are configured in such a way that the upper jointing clamp half and the lower jointing clamp half need to be arranged in an intermediate position in order to respectively move the first and the second synchronization plates relative to the upper jointing clamp half, as well as relative to the lower jointing clamp half.

8. The jointing clamp according to claim 1, wherein the jointing clamp is configured such that the upper jointing clamp half and the lower jointing clamp half are blocked in an intermediate position.

9. The jointing clamp according to claim 2, wherein at least one of the upper jointing clamp half and the lower jointing clamp half respectively consists of a pair of plates, wherein the pair of plates comprise at least two plates of substantially a same shape that are arranged adjacent to one another in the transverse direction and spaced apart from one another, wherein a respective one of the first and the second synchronization plate is transversely arranged between the two plates of the pair of plates of each of the upper jointing clamp half and the lower jointing clamp half.

10. The jointing clamp according to claim 2, wherein the first synchronization plate and the second synchronization plate are arranged adjacent one another in the transverse direction and rotationally symmetrical to one another.

11. The jointing clamp according to claim 2, wherein the first synchronization plate and the second synchronization plate are made of sheet metal.

12. The jointing clamp according to claim 1, wherein the upper and the lower jointing clamp halves or the upper and the lower contour elements consist of a metal casting or metal punching.

13. A pressing tool comprising the jointing clamp according to claim 1.

* * * * *